US007147052B2

(12) United States Patent
Erkol

(10) Patent No.: US 7,147,052 B2
(45) Date of Patent: Dec. 12, 2006

(54) HYRAULICALLY RELEASABLE INFLATION TOOL FOR PERMANENT BRIDGE PLUG

(75) Inventor: Zafer Erkol, Stafford, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 11/344,377

(22) Filed: Jan. 31, 2006

(65) Prior Publication Data

US 2006/0124296 A1 Jun. 15, 2006

(51) Int. Cl.
*E21B 23/00* (2006.01)

(52) U.S. Cl. ..... 166/181; 166/383; 166/373; 166/194; 166/182

(58) Field of Classification Search ..... 166/181, 166/123, 377, 381, 383, 386, 387, 373, 194, 166/155, 130, 182, 184, 185
See application file for complete search history.

(56) References Cited

U.S. PATENT DOCUMENTS 2,618,344 A * 11/1952 Turechek et al. ..... 166/63
3,208,532 A * 9/1965 Chenoweth ..... 277/333
3,316,969 A * 5/1967 Smith ..... 166/387
4,089,548 A * 5/1978 Gurley ..... 285/3
4,485,876 A * 12/1984 Speller ..... 166/373
4,648,448 A * 3/1987 Sanford et al. ..... 166/187
4,869,324 A * 9/1989 Holder ..... 166/387
4,893,678 A * 1/1990 Stokley et al. ..... 166/374
5,383,520 A * 1/1995 Tucker et al. ..... 166/142
6,230,798 B1 * 5/2001 Appleton ..... 166/187
6,318,470 B1 * 11/2001 Chang et al. ..... 166/377
6,808,023 B1 * 10/2004 Smith et al. ..... 166/386
2003/0062169 A1 * 4/2003 Marshall ..... 166/377

* cited by examiner

*Primary Examiner*—Jennifer H. Gay
*Assistant Examiner*—Daniel P Stephenson
(74) *Attorney, Agent, or Firm*—Tim Curington; Robin Nava; Dale Graudier

(57) ABSTRACT

Various embodiments of an improved downhole disconnect tool are provided, some of which may include a first housing releasably connected to a second housing, a first piston releasably connected to the first housing, and a second piston releasably connected to the second housing. Various fluid communication ports and ball seats may be provided in various combinations in the first and second pistons and in the second housing to enable remote control of the tool by circulating one or more balls into engagement with one or more of the ball seats to disconnect the first housing from the second housing, and thereby disconnect any structures connected to the first and second housings, respectively. Other features and aspects of the invention are also provided.

6 Claims, 4 Drawing Sheets

HYRAULICALLY RELEASABLE INFLATION TOOL FOR PERMANENT BRIDGE PLUG

BACKGROUND OF THE INVENTION

1. Field of the Invention

The present invention relates to subsurface well equipment and, more particularly, to an apparatus for remotely disconnecting downhole well tools and/or conduits from one another.

2. Description of the Related Art

The present invention was developed in response to a problem that exists with the current manner in which an inflatable packer located downhole is remotely disconnected from a production tubing, such as a coiled tubing, to which the packer is connected, such as in a permanent bridge plug application. One current approach to remotely disconnecting the packer from the tubing is through a mechanical release joint that is disposed between the packer and the tubing. The mechanical release joint consists generally of two tubular members, one of which is partially disposed within the other. The tubular members are connected to one another by shear screws. One tubular member is connected to the tubing, and the other is connected to the packer. The mechanical release joint is designed such that when it is desired to disconnect the tubing from the packer, a force of sufficient magnitude is applied to the tubing so that the shear screws will shear, thus disconnecting the two tubular members of the mechanical release joint, and thereby also disconnecting the tubing from the packer. One problem with this type of mechanical release joint, however, is that it may be unintentionally actuated by unforeseen downhole conditions, such as pressure or flow rate variations that are sufficiently large to shear the shear screws. As such, the present invention was developed to provide an improved release joint that is not prone to being unintentionally actuated by unforeseen downhole conditions.

SUMMARY OF THE INVENTION

In one aspect, the invention may be a disconnect tool for use in a subterranean well, comprising: a first housing releasably connected to a second housing, the second housing having a circulation port and an inner bore therethrough; a first piston releasably connected to the first housing, and having an inner bore therethrough and an upper ball seat; and a second piston releasably connected to the second housing and having an inner bore therethrough and a lower ball seat, the lower ball seat having a diameter less than a diameter of the upper ball seat, the second piston having a run-in circulation port, an inflation port, and a secondary circulation port, the run-in circulation port being in fluid communication with the circulation port in the second housing before a lower ball is engaged with the lower ball seat, the inflation port directing fluid flow from the inner bore of the first piston to a portion of the inner bore of the second housing below the lower ball seat when the lower ball is engaged with the lower ball seat, and the secondary circulation port being in fluid communication with the circulation port in the second housing after the second piston is disconnected from the second housing, the first piston being disconnected from the first housing after an upper ball is engaged with the upper ball seat to thereby disconnect the first housing from the second housing. Another feature of this aspect of the invention may be that the first housing may further include a lower extension including at least one locking member adapted for releasable engagement with a locking groove in the second housing, and the first piston includes an outer recess disposed to receive the at least one locking member after the first piston has been disconnected from the first housing. Another feature of this aspect of the invention may be that the first piston is disposed to maintain engagement of the at least one locking member with the locking groove before the first piston is disconnected from the first housing. Another feature of this aspect of the invention may be that the second piston is releasably connected to the second housing by at least one shear screw designed to shear at a force corresponding to a maximum setting pressure of a packer to which the tool is connected. Another feature of this aspect of the invention may be that the run-in circulation port is disposed below the lower ball seat. Another feature of this aspect of the invention may be that the inflation port is disposed above the lower ball seat. Another feature of this aspect of the invention may be that the secondary circulation port is disposed between the run-in circulation port and the inflation port. Another feature of this aspect of the invention may be that the inflation port is disposed between the lower ball seat and the secondary circulation port. Another feature of this aspect of the invention may be that the second housing may further include a fluid passageway establishing fluid communication between the inflation port and the inner bore of the second housing below the lower ball seat. Another feature of this aspect of the invention may be that the second housing may further include at least one closure member having an open and a closed position, and adapted to restrict fluid flow through the inner bore of the second housing when in its closed position and permit fluid flow through the inner bore of the second housing when in its open position. Another feature of this aspect of the invention may be that the second piston may further include an inflation reentry port disposed below the lower ball seat, and a stopper is sealingly disposed within the second housing to direct fluid flow through the inflation reentry port into the inner bore of the second piston. Another feature of this aspect of the invention may be that the tool may further include an orifice plug engaged with an orifice in the second piston establishing fluid communication between the inflation port and the circulation port in the second housing.

In another aspect, the present invention may be a disconnect tool for use in a subterranean well, comprising: a first housing releasably connected to a second housing, the second housing having a first fluid circulation port, a second circulation port, and an inner bore therethrough; a first piston releasably connected to the first housing, and having an inner bore therethrough, an upper ball seat and a lower ball seat, the lower ball seat having a diameter less than a diameter of the upper ball seat, the first piston having a run-in circulation port and an inflation port, the run-in circulation port being in fluid communication with the first circulation port in the second housing before a lower ball is engaged with the lower ball seat, the inflation port directing fluid flow from the inner bore of the first piston to a portion of the inner bore of the second housing below the lower ball seat when the lower ball is engaged with the lower ball seat; and a second piston releasably connected to the second housing, the inflation port being in fluid communication with the second circulation port in the second housing after the second piston is disconnected from the second housing, the first piston being disconnected from the first housing after a second ball is engaged with the upper ball seat to thereby disconnect the first housing from the second housing. Another feature of this aspect of the invention may be that the tool may further include an orifice plug engaged with an orifice in the second piston establishing fluid communication between the inflation port and the circulation port in the second housing. Another feature of this aspect of the invention may be that the first housing may further include a lower extension including at least one locking member adapted for releasable engagement with a locking groove in the second housing, and the first piston includes an outer recess disposed to receive the at least one locking member after the first piston has been disconnected from the first housing. Another feature of this aspect of the invention may be that the first piston is disposed to maintain engagement of the at least one locking member with the locking groove before the first piston is disconnected from the first housing. Another feature of this aspect of the invention may be that the second piston is releasably connected to the second housing by at least one shear screw designed to shear at a force corresponding to a maximum setting pressure of a packer to which the tool is connected. Another feature of this aspect of the invention may be that the second housing may further include at least one closure member having an open and a closed position, and adapted to restrict fluid flow through an inner bore of the second housing when in its closed position and permit fluid flow through the inner bore of the second housing when in its open position.

In yet another aspect, the present invention may be a disconnect tool for use in a subterranean well, comprising: a first housing releasably connected to a second housing, the second housing having a circulation port and an inner bore therethrough; a first piston releasably connected to the first housing, and having an inner bore therethrough and an upper ball seat; a second piston releasably connected to the second housing and having a run-in circulation port in fluid communication with the circulation port in the second housing before the second piston is disconnected from the second housing, and a secondary circulation port in fluid communication with the circulation port in the second housing after the second piston is disconnected from the second housing, the first piston being disconnected from the first housing after an upper ball is engaged with the upper ball seat to thereby disconnect the first housing from the second housing; and an orifice plug engaged with the run-in circulation port. Another feature of this aspect of the invention may be that the first housing may further include a lower extension including at least one locking member adapted for releasable engagement with a locking groove in the second housing, and the first piston includes an outer recess disposed to receive the at least one locking member after the first piston has been disconnected from the first housing. Another feature of this aspect of the invention may be that the first piston is disposed to maintain engagement of the at least one locking member with the locking groove before the first piston is disconnected from the first housing. Another feature of this aspect of the invention may be that the second piston is releasably connected to the second housing by at least one shear screw designed to shear at a force corresponding to a maximum setting pressure of a packer to which the tool is connected. Another feature of this aspect of the invention may be that the second housing may further include at least one closure member having an open and a closed position, and adapted to restrict fluid flow through an inner bore of the second housing when in its closed position and permit fluid flow through the inner bore of the second housing when in its open position.

In still another aspect, the present invention may be a disconnect tool for use in a subterranean well, comprising: a first housing releasably connected to a second housing, the second housing having a first circulation port, a second circulation port, and an inner bore therethrough; an orifice plug engaged with the first circulation port; a first piston releasably connected to the first housing, and having an inner bore therethrough, an upper ball seat, and a run-in circulation port establishing fluid communication between the inner bore of the first piston and the first circulation port; and a second piston releasably connected to the second housing, the run-in circulation port being in fluid communication with the second circulation port after the second piston is disconnected from the second housing, the first piston being disconnected from the first housing after an upper ball is engaged with the upper ball seat to thereby disconnect the first housing from the second housing. Another feature of this aspect of the invention may be that the first housing may further include a lower extension including at least one locking member adapted for releasable engagement with a locking groove in the second housing, and the first piston includes an outer recess disposed to receive the at least one locking member after the first piston has been disconnected from the first housing. Another feature of this aspect of the invention may be that the first piston is disposed to maintain engagement of the at least one locking member with the locking groove before the first piston is disconnected from the first housing. Another feature of this aspect of the invention may be that the second piston is releasably connected to the second housing by at least one shear screw designed to shear at a force corresponding to a maximum setting pressure of a packer to which the tool is connected. Another feature of this aspect of the invention may be that the second housing may further include at least one closure member having an open and a closed position, and adapted to restrict fluid flow through the inner bore of the second housing when in its closed position and permit fluid flow through the inner bore of the second housing when in its open position. Another feature of this aspect of the invention may be that the second piston is sealably disposed between the second housing and the first piston. Another feature of this aspect of the invention may be that the tool may further include a secondary inflation piston releasably connected to the second housing by at least one shear screw designed to shear at a force corresponding to a pressure less than a maximum setting pressure of a packer to which the tool is connected, fluid communication between the run-in circulation port and the first circulation port being restricted after the secondary inflation piston is disconnected from the second housing, and fluid communication between the run-in circulation port and the second circulation port being established after the second piston is disconnected from the second housing. Another feature of this aspect of the invention may be that the tool may further include a nut having a one-way ratchet mechanism adapted to allow movement of the secondary inflation piston in only one direction. Another feature of this aspect of the invention may be that the tool may further include a spring disposed between a lower support shoulder on the second housing and the secondary inflation piston.

Figure 1:
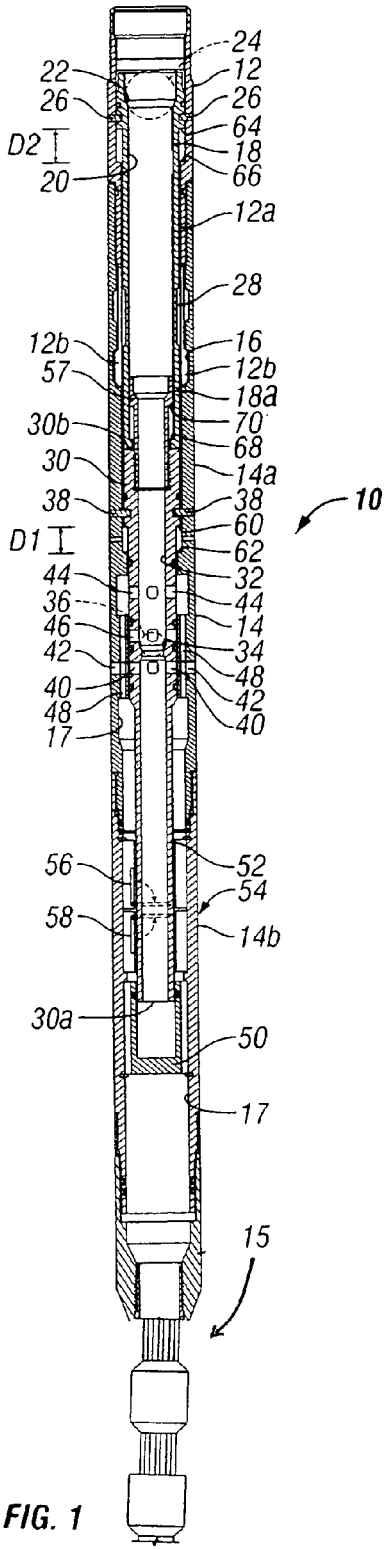
FIG. 1 is a side cross-sectional view of a first embodiment of the improved release tool of the present invention.

While the invention will be described in connection with the preferred embodiments, it will be understood that it is not intended to limit the invention to those embodiments. On the contrary, it is intended to cover all alternatives, modifications, and equivalents as may be included within the scope of the invention as defined by the appended claims.

DESCRIPTION OF THE PREFERRED EMBODIMENTS

In the description that follows, like or similar parts are marked through the specification and drawings with the same reference numerals, respectively. The figures are not necessarily drawn to scale, and in some instances, have been exaggerated or simplified to clarify certain features of the invention. One skilled in the art will appreciate many differing applications of the described apparatus.

Referring to FIG. 1, a first embodiment of the improved release tool 10 of the present invention is shown in a run-in position, prior to being actuated. In this embodiment, the tool 10 includes a first, or upper, housing 12 that is releasably connected to a second, or lower, housing 14. The upper housing 12 is adapted for connection to a production or coiled tubing or perhaps another tool (not shown), and the lower housing 14 is shown connected to a packer 15, only an upper portion of which is shown. In a specific embodiment, the lower housing 14 may comprise an upper member (or fish neck housing) 14*a* and a lower member 14*b*. The upper housing 12 may include a lower extension 12*a* that is disposed within the lower housing 14. The lower extension 12*a* may include at least one locking member or dog 12*b* adapted for releasable engagement with a locking groove 16 in the lower housing 14. As will be more fully explained below, the lower extension 12*a* is designed to flex inwardly, away from the lower housing 14, such that the one or more locking dogs 12*b* will disengage from the locking groove 16 when the dogs 12*b* are not being held in engagement with the groove 16.

The tool 10 further includes a first, or release, piston 18 that is shown partially disposed within the upper housing 12 and partially disposed within the lower housing 14. The release piston 18 includes an inner bore 20 having a first, or upper, ball seat 22 adapted for engagement with an upper ball 24 (shown in phantom), the purpose of which will be explained below. The release piston 18 is releasably connected to the upper housing 12 by at least one shear screw 26. A lower portion 18*a* of the release piston 18 is disposed to hold the locking dogs 12*b* on the upper housing 12 in engagement with the locking groove 16 on the lower housing 14 when the tool 10 is in its run-in position. The release piston 18 further includes an outer recess 28 for receiving the locking dogs 12*b* when the tool 10 is being actuated, as will be further discussed below. Other aspects of the release piston 18 will be described below when describing the operation of the tool 10.

The tool 10 further includes a second, or inflation, piston 30 disposed below the release piston 18 and within the lower housing 14. The inflation piston 30 includes an inner bore 32 having a second, or lower, ball seat 34 adapted for engagement with a lower ball 36 (shown in phantom), the purpose of which will be explained below. The diameter of the lower ball seat 34 is less than the diameter of the upper ball seat 22. The inflation piston 30 is releasably connected to the lower housing 14 by at least one shear screw 38, which is designed to shear at a predetermined force corresponding to a preselected maximum setting pressure for the packer 15. The inflation piston 30 includes at least one run-in circulation port 40 disposed below the lower ball seat 34 (i.e., between the lower ball seat 34 and a lower end 30*a* of the inflation piston 30). When the tool 10 is in its run-in position, as shown, the run-in circulation ports 40 are generally aligned and in fluid communication with corresponding circulation ports 42 in the lower housing 14. The inflation piston 30 further includes at least one inflation port 44 above the lower ball seat 34 (i.e., between the lower ball seat 34 and an upper end 30*b* of the piston 30). The at least one inflation port 44 is adapted to direct fluid flow from the inner bore 20 of the release piston 18 to a portion of an inner bore 17 of the lower housing 14 below the lower ball seat 34 when the lower ball 36 is engaged with the lower ball seat 34. The inflation piston 30 further includes at least one secondary circulation port 46 disposed between the lower ball seat 34 and the at least one inflation port 44. The lower housing 14 includes at least one fluid passageway 48 through which fluid may flow from the inner bore 32 of the inflation piston 30 and the inflation ports 44 down through the inner bore 17 to the packer 15, as will be more fully discussed hereinbelow. The lower end 30*a* of the inflation piston 30 is sealably disposed within a bottom stopper 50 that is connected to the lower housing 14. The inflation piston 30 may also include a sleeve section 52 disposed through a flapper check valve assembly or cartridge 54 of the type known to those of skill in the art. In a specific embodiment, the assembly 54 may include an upper closure member 56 (e.g., a flapper) and a lower closure member 58, each shown in their closed positions in dashed lines. The inflation piston 30 may also include a locking nut 57 connected to the upper end 30*b* of the piston 30, the purpose of which will be explained below.

In operation, the tool 10 is run into a well (not shown) to its setting depth, and fluid is pumped down the tubing (not shown), into the tool 10 and circulated through the run-in circulation ports 40 in the inflation piston 30 and out through the circulation ports 42 in the lower housing 14. The lower ball 36 is placed into the fluid stream and pumped into engagement with the lower ball seat 34. This will restrict circulating fluid flow through ports 40 and 42, and will divert fluid flow through the inflation ports 44 and the fluid passageways 48 down to the inflatable packer 15. Fluid pressure will build up to set the packer 15. This is done in this embodiment using the bull head inflation method, as will be understood by those of skill in the art. When the predetermined maximum setting pressure of the packer 15 is reached, the shear screws 38 connecting the inflation piston 30 to the lower housing 14 will shear, thereby disconnecting the inflation piston 30 from the lower housing 14. The inflation piston 30 will then move downwardly by a first distance D1 until a shoulder 60 on the piston 30 engages a ledge 62 on the lower housing 14. This will bring the secondary circulation ports 46 on the inflation piston 30 into fluid communication with the circulation ports 42 in the lower housing 14, and again permit fluid circulation from the earth's surface through the tool 10, and cause the pressure to drop in the tubing (not shown).

Having again established fluid circulation through the tool 10, fluid can be produced to the earth's surface from the well until it is desired to actuate the tool 10 to disconnect the tubing from the packer 15. At that time, the upper ball 24 (which is larger than the lower ball 36) is placed into the fluid stream and pumped downhole into engagement with the upper ball seat 22. Pressure is allowed to build up until shear screws 26 shear, thereby disconnecting the release piston 18 from the upper housing 12. The release piston 18 will then move downwardly by a second distance D2 until a shoulder 64 on the release piston 18 engages a ledge 66 on the upper housing 12. It is preferred that the first distance D1 is greater than the second distance D2 so that there will be some space between the lower end of the release piston 18 and the upper end 30*b* of the inflation piston 30 after both the release piston 18 and the inflation piston 30 have been shifted downwardly to their respective released positions (not shown). When the release piston 18 is shifted downwardly to its released position, the outer recess 28 on the release piston 18 will be positioned adjacent the locking dogs 12*b* on the upper housing 12, and the locking dogs 12*b* will be inwardly flexed into the outer recess 28, thereby disengaging the upper housing 12 from the lower housing 14. This also disconnects the tubing (not shown) from the packer 15.

The tubing (not shown) may now be removed from the well (not shown) by pulling upwardly thereon. This will pull the upper housing 12, which will engage the ledge 66 of the upper housing 12 on the shoulder 64 of the release piston 18, and thereby cause upward movement of the release piston 18. This will cause a ledge 68 on the inner bore 20 of the release piston 18 to engage a shoulder 70 on the locking nut 57, and thereby cause upward movement of the inflation piston 30. As the inflation piston 30 is pulled upwardly, the sleeve section 52 of the inflation piston 30 will pass through the flapper assembly 54 so that the lower flapper 58 will rotate upwardly to its closed position (shown in dashed lines) and the upper flapper 56 will rotate downwardly to its closed position (also shown in dashed lines). This will prevent any fluid or contaminants from migrating down into the packer 15. The upper housing 12, release piston 18 and inflation piston 30 may then be pulled to the surface, leaving the packer 15 and lower housing 14 in the well. If it is desired to extract the packer 15 to the surface, a gripping tool of the type known to those in the art (not shown) may be lowered into the well and engaged with the locking groove 16 on the lower housing 14. Once engaged, the gripping tool may then pull the lower housing 14 and packer 15 to the earth's surface in a known manner.

Figure 2A:
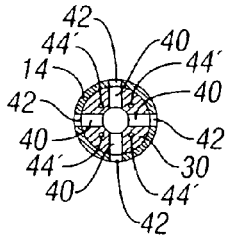
FIG. 2A is a cross-sectional view taken along line 2A—2A of FIG. 2.
Figure 2:
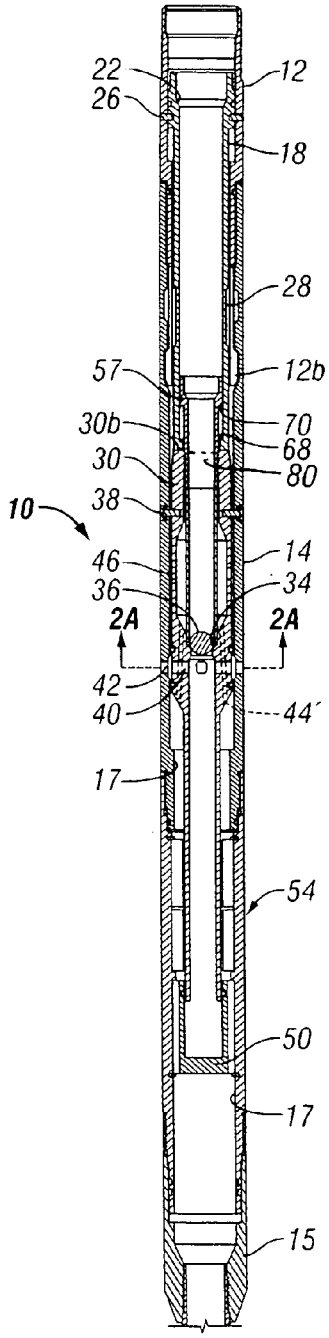
FIG. 2 is a side cross-sectional view of a second embodiment of the improved release tool of the present invention.

A second embodiment of the present invention is shown in FIGS. 2 and 2A. The second embodiment is similar to the first embodiment shown in FIG. 1. The main differences between the first and second embodiments are in the structure of the inflation piston 30 and lower housing 14. In the second embodiment, the inflation ports 44' in the inflation piston 30 are disposed in a generally longitudinal direction, whereas in the first embodiment the inflation ports 44 are disposed in a generally transverse direction. The longitudinal inflation ports 44' take the place of the fluid passageways 48 in the lower housing 14 in the first embodiment shown in FIG. 1. Also, in the second embodiment, the longitudinal inflation ports 44' are disposed between the lower ball seat 34 and the secondary circulation ports 46, whereas in the first embodiment the secondary circulation ports 46 are disposed between the lower ball seat 34 and the inflation ports 44. Another difference is that the second embodiment may also include a filter 80 disposed within the inflation piston 30 above the lower ball seat 34 to prevent contaminants from flowing into the ports 44' or 46.

The operation of the second embodiment is very similar to that of the first embodiment. The tool 10 is run into the hole to its setting depth and fluid circulation is established through the ports 40 and 42. The lower ball 36 is then dropped into engagement with the lower ball seat 34, and fluid flow is diverted through the inflation ports 44' to inflate the packer 15. When the packer 15 reaches its maximum pressure, the shear screws 38 will shear and the piston 30 will move downwardly into its released position, at which time the secondary circulation ports 46 will be in fluid communication with the circulation ports 42, thereby permitting fluid circulation through the tool 10. To disconnect from the packer 15, the upper ball 24 is dropped into engagement with the upper ball seat 22, and pressure-is allowed to build up until the shear screws 26 are sheared. The release piston 18 then moves down and the locking dogs 12*b* retract into the outer recess 28, thereby disengaging the upper housing 12 from the lower housing 14. The upper housing 12, release piston 18 and inflation piston 30 may then be pulled to the surface. A gripping tool may also be used to pull the lower housing 14 and packer 15 to the surface, if so desired, in the manner explained above.

Figure 3:
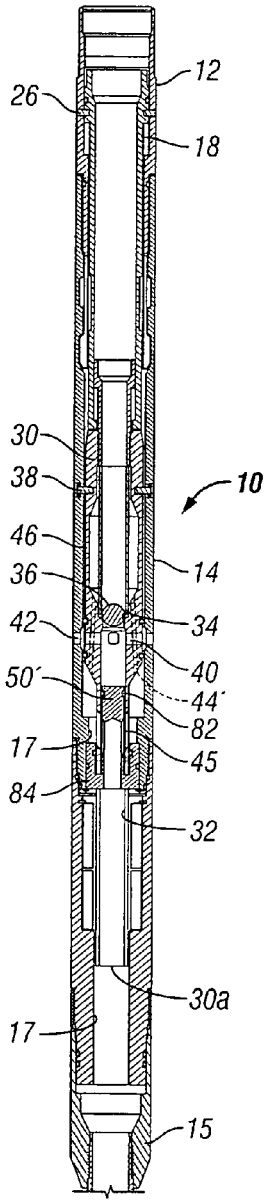
FIG. 3 is a side cross-sectional view of a third embodiment of the improved release tool of the present invention.

A third embodiment of the present invention is shown in FIG. 3. The third embodiment is similar to the second embodiment shown in FIG. 2. The main differences between the second and third embodiments are in the structure of the inflation piston 30 and the structure and position of the stopper 50. With reference to FIG. 3, the inflation piston 30 includes at least one inflation reentry port 45 disposed below the lower ball seat 34 (i.e., between the lower ball seat 34 and the lower end 30*a* of the inflation piston 30). After the lower ball 36 has been dropped, fluid flow is diverted through the inflation ports 44' and then back into the inner bore 32 of the inflation piston 30 through the at least one inflation reentry port 45, and then to the packer 15. The other difference between the second and third embodiments is that in the third embodiment the stopper 50' includes an inner seal member 82 and an outer seal shoulder 84. When in the run-in position, as shown, the inner seal member 82 is disposed above the at least one inflation reentry port 45 for sealable engagement with the inner bore 32 of the inflation piston 30, and the outer seal shoulder 84 is disposed below the at least one inflation reentry port 45 for sealable engagement between the lower housing 14 and the inflation piston 30. It will be understood that the inner seal member 82 and outer seal shoulder 84 cooperate to provide a sealed flow path to direct inflation fluids under pressure down to the packer 15 for inflation of same. The operation of this third embodiment is as explained above for the second embodiment.

Figure 4A:
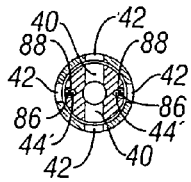
FIG. 4A is a cross-sectional view taken along line 4A—4A of FIG. 4.
Figure 4:
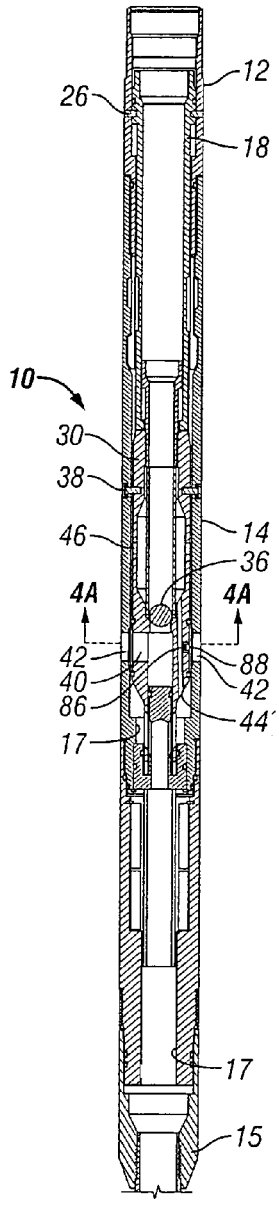
FIG. 4 is a side cross-sectional view of a fourth embodiment of the improved release tool of the present invention.

A fourth embodiment of the present invention is shown in FIGS. 4 and 4A, which is similar to the third embodiment shown in FIG. 3. The key difference between the two is that the fourth embodiment employs an orifice plug method of inflating the packer 15 whereas the third embodiment employs the bull plug inflation method. As shown in FIG. 4, in the fourth embodiment, the inflation piston 30 includes an orifice 86 for each longitudinal inflation port 44' that establishes fluid communication between the corresponding longitudinal inflation port 44' and the circulation ports 42 in the lower housing 14. By providing the orifices 86, some of the fluid flowing through the inflation ports 44' to set the packer 15 is allowed to escape through the orifices 86 and the circulation ports 42 in the lower housing 14. The amount of fluid that is allowed to escape through the orifices 86 may be controlled by engaging an orifice plug 88 with each orifice 86 in a known manner. The size of the orifice plug 88 may be varied depending on the desired maximum inflation pressure of the packer 15. This provides for additional control over the inflation of the packer 15. Other than these differences, the operation of this fourth embodiment is as explained above for the third embodiment.

Figure 5:
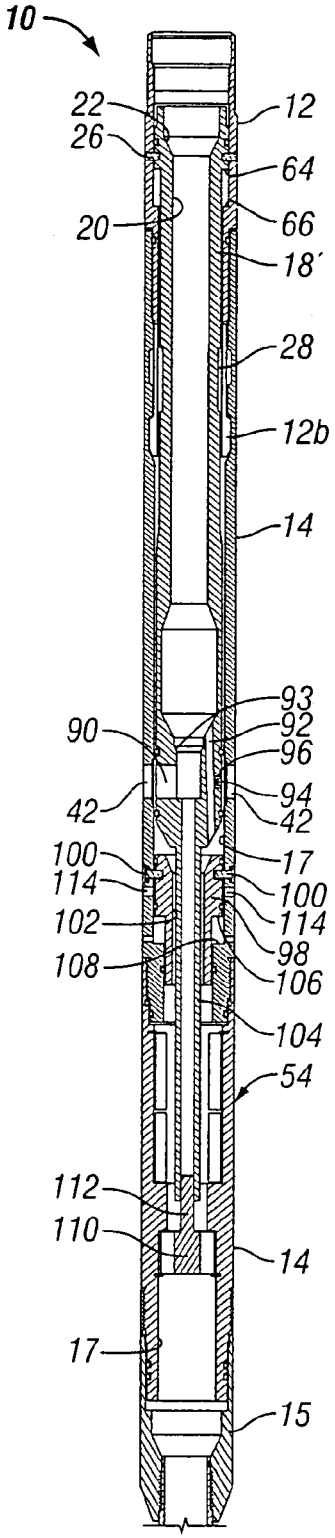
FIG. 5 is a side cross-sectional view of a fifth embodiment of the improved release tool of the present invention.

A fifth embodiment of the present invention is shown in FIG. 5, which includes an upper housing 12 and a lower housing 14 generally as described above in connection with FIGS. 1–4. The fifth embodiment also includes a release piston 18' the structure of which is similar in some respects and different in others in comparison to the release piston 18 as described in FIGS. 1–4. The release piston 18' as shown in FIG. 5 also includes certain features of the inflation piston 30 shown in FIGS. 1–4. As shown in FIG. 5, the release piston 18' is connected to the upper housing 12 by shear screws 26, and includes an inner bore 20, and an outer recess 28 for receiving the locking dogs 12*b*. The release piston 18' also includes a circulation port 90 that establishes fluid communication between the inner bore 20 and the circulation ports 42 (which may also be referred to as first circulation ports) in the lower housing 14, when the tool 10 of this fifth embodiment is in its run-in position, as shown in FIG. 5. The release piston 18' further includes a generally longitudinal inflation port 92 establishing fluid communication from the inner bore 20 above a lower ball seat 93 to an exterior of the release piston 18' at a point below the lower ball seat 94. The release piston 18' may further include an orifice 94 establishing fluid communication between the inflation port 92 and the circulation ports 42 in the lower housing 14. An orifice plug 96 may be engaged with the orifice 94. The function, structure and operation of the orifice 94 and orifice plug 96 are as explained above in connection with FIG. 4. This fifth embodiment further includes an inflation piston 98 secured by shear screws 100 to the lower housing 14. The inflation piston 98 includes an inner bore 102 through which a sleeve member 104 of the release piston 18' is disposed when the tool 10 is in its run-in position, as shown. The inflation piston 98 also includes a shoulder 106 adapted to stop against a ledge 108 on the lower housing 14. A plug member 110 may be attached to the lower housing 14 and provided with a stem 112 adapted for sealable engagement with a lower end of the inner bore 20 of the release piston 18'. This fifth embodiment may also include a flapper assembly 54 as described and illustrated above.

In operation, the fifth embodiment of the tool 10 is run into the well in its run-in position as shown in FIG. 5, and fluid circulation is established through the inner bore 20, the circulation port 90, and the circulation ports 42 in the lower housing 14. A lower ball (not shown) is then dropped into engagement with the lower ball seat 93. This diverts fluid flow into the inflation passageway 92, some of which escapes through the orifice 94 and the remainder of which continues downwardly through an annulus between the sleeve member 104 of the release piston 18' and the inner bore 102 of the inflation piston 98, and on down to inflate the packer 15. When the maximum inflation pressure of the packer 15 is reached, the shear screws 100 will shear and the inflation piston 98 will move downwardly until the shoulder 106 comes to rest against the ledge 108. This will result in a pressure drop, and will establish a fluid flow path out of the tool 10 through one or more second circulation ports 114 in the lower housing 14, which may be disposed below the first circulation ports 42 in the lower housing. This will again permit fluid circulation through the tool 10, and, when it desired to disconnect from the packer 15, an upper ball (not shown) may then be dropped into engagement with the upper ball seat 22. This will cause pressure to build up above the release piston 18', which pressure will eventually shear the shear screws 26 and move the release piston 18' downwardly until shoulder 64 comes to rest against the ledge 66. This will result in the locking dogs 12*b* retracting into the outer recess 28, thereby disconnecting the upper housing 12 from the lower housing 14, in the manner as explained above in connection with the other embodiments. The upper housing 12 may then be pulled to the surface, which will also pull the release piston 18' to the surface. The lower housing 14, inflation piston 98 and packer 15 will remain in the well. If it is desired to remove these components, an appropriate well tool (not shown) may be used to latch into the profile 16 at the top of the lower housing 14 to pull these remaining components to the surface in a known manner.

Figure 6:
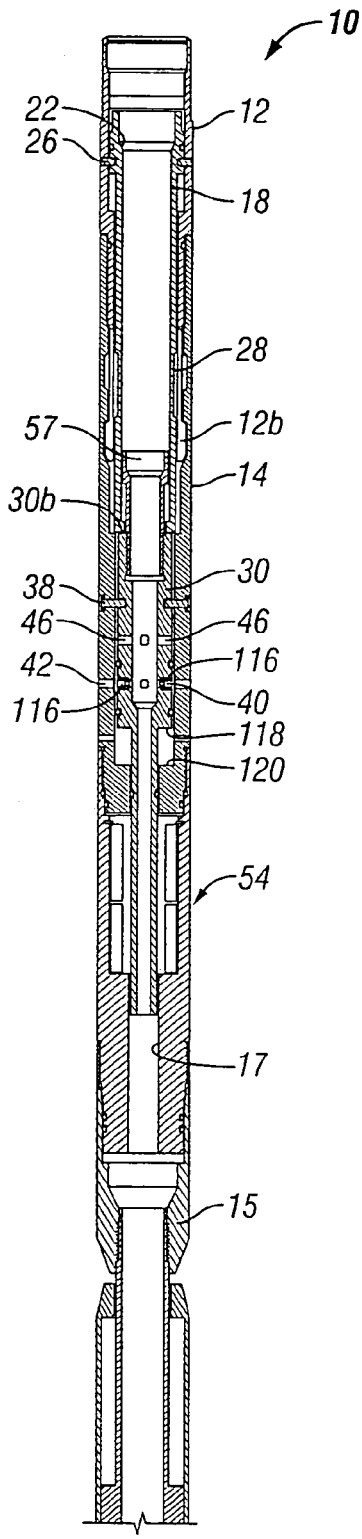
FIG. 6 is a side cross-sectional view of a sixth embodiment of the improved release tool of the present invention.

A sixth embodiment of the present invention is shown in FIG. 6. This sixth embodiment has an upper housing 12, a lower housing 14 and a release piston 18, similar to those shown in FIGS. 1–4. The structure of the inflation piston 30 in this embodiment is different than in FIGS. 1–4, and this embodiment does not use a lower ball, but, instead, only the upper ball. The inflation piston 30 is connected to the lower housing 14 by shear screws 38. The run-in circulation ports 40 on the piston 30 are in fluid communication with the circulation ports 42 in the lower housing when the tool 10 is in its run-in position, as shown. In a preferred embodiment, an orifice plug 116 is disposed in each run-in circulation port 40. The inflation piston 30 also includes secondary circulation ports 46 disposed between the run-in circulation ports 40 and the upper end 30*b* of the piston 30.

In operation, the sixth embodiment is run into the well (not shown) to its setting depth and pressurized fluid is pumped down to the packer 15 to set it using the orifice inflation method. Note that it is not necessary in this sixth embodiment to drop a lower ball, as was explained in connection with the above embodiments. As described above, using the orifice inflation method, some of the fluid will escape from the tool 10 through the run-in circulation ports 40, which are partially blocked by the orifice plugs 116, and the remainder of the fluid will flow down to the packer 15 to set it. When the maximum packer inflation pressure is reached, the shear screws 38 will shear and the piston 30 will move downwardly until a shoulder 118 on the piston 30 comes to rest against a ledge 120 on the lower housing 14. This will result in the secondary circulation ports 46 moving into alignment with the circulation ports 42 in the lower housing 14, and thereby again enable fluid circulation through the tool 10. This will allow the upper ball (not shown) to be dropped into engagement with the upper ball seat 22 when it is desired to disconnect the tubing (not shown) from the packer 15. Dropping the upper ball (not shown) will result in the shear screws 26 shearing and downward movement of the release piston 18 to disconnect the upper housing 12 from the lower housing 14, as more fully explained above in connection with the other embodiments.

Figure 7:
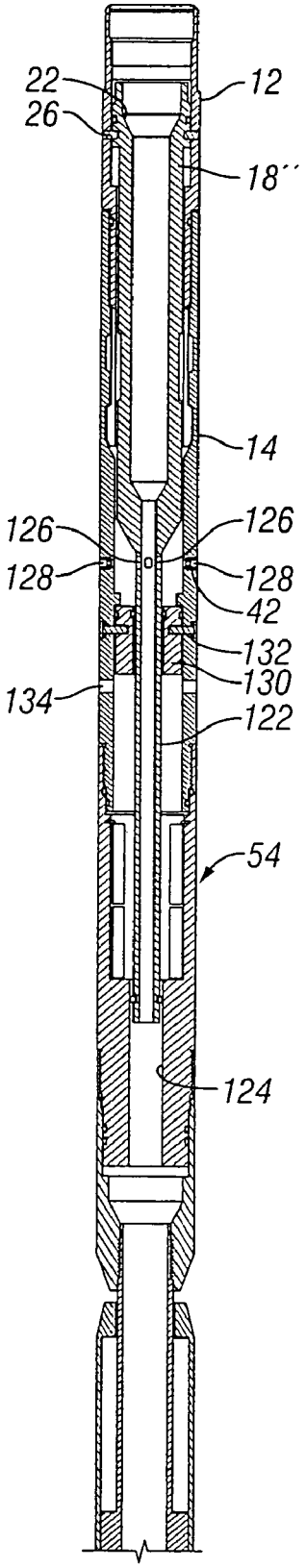
FIG. 7 is a side cross-sectional view of a seventh embodiment of the improved release tool of the present invention.

A seventh embodiment of the present invention is shown in FIG. 7. This seventh embodiment has an upper housing 12 and a lower housing 14, similar to those shown in FIGS. 1–4. This seventh embodiment also includes a release piston 18" similar to the release pistons shown in FIGS. 1–4, except that the release piston 18" further includes a lower extension member 122 that extends through the flapper assembly 54 and is sealably engaged with a lower bore 124 of the lower housing 14. The release piston 18" further includes at least one run-in circulation port 126 that may be located adjacent and in fluid communication with the circulation ports 42 in the lower housing 14 when the tool 10 is in its run-in position, as shown. In this embodiment, an orifice plug 128 is engagingly disposed in each of the circulation ports 42 in the lower housing 14. This embodiment further includes an inflation piston 130 releasably secured by shear pins 132 to the lower housing 14, and sealably disposed between the lower housing 14 and the release piston 18". The lower housing 14 also includes at least one secondary circulation port 134 disposed below the circulation ports 42 in the lower housing 14.

In operation, the tool 10 is run into the hole to its setting depth, and fluid is pumped downhole to set the packer 15 using the orifice inflation method. Some of the fluid will escape through the run-in circulation ports 126 in the release piston 18" and the circulation ports 42, which are partially blocked by the orifice plugs 128, and the remainder of the fluid will flow further downhole to set the packer 15. When the packer 15 reaches its maximum setting pressure, the shear screws 132 will shear and the inflation piston 130 will move downwardly to establish a fluid flow path between the circulation ports 126 in the release piston 18" and the secondary circulation ports 134 in the lower housing 14. This will allow fluid circulation again, and when desired, the upper ball (not shown) can be dropped into engagement with the upper ball seat 22 to disconnect the tubing (not shown) and upper housing 12 from the lower housing 14 and packer 15, in the same manner as discussed above. It is noted that, in this seventh embodiment, due to the use of the orifice inflation method, it is not necessary to drop a lower ball in order to set the packer 15.

Figure 8:
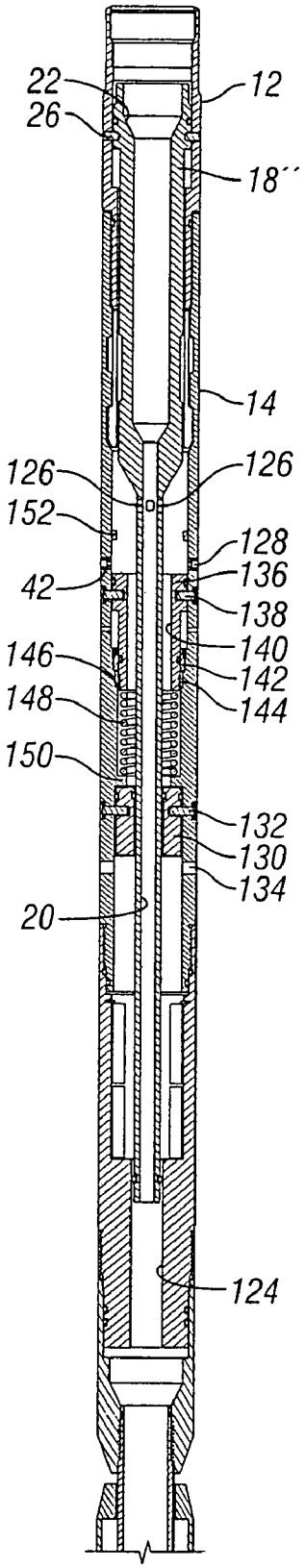
FIG. 8 is a side cross-sectional view of an eighth embodiment of the improved release tool of the present invention.

An eighth embodiment of the present invention is shown in FIG. 8. This eighth embodiment is similar to the seventh embodiment, but includes additional components in the area between the inflation piston 130 (referred to below as the primary inflation piston) and the run-in circulation ports 126 on the release piston 18". These additional components, as described below, are sometimes generally referred to as "Circulate Inflate Orifice Tool" (CIOT) components, and may include: a secondary inflation piston 136 connected to the lower housing 14 by shear screws 138 and having an inner bore 140 through which the lower extension member 122 of the release piston 18" may be disposed; a nut 142 including a one-way ratchet mechanism and disposed about a lower portion of the secondary inflation piston 136; a lock member 144 disposed about a lower portion of the secondary inflation member 136 between the nut 142 and a locking shoulder 146 on the inner bore of the lower housing 14; a spring 148 disposed within the lower housing 14 around the lower extension member 122 and between the secondary inflation piston 136 and a lower support shoulder 150 on the lower housing 14; and an upper support shoulder 152 on the lower housing 14 above the secondary inflation piston 136. In a specific embodiment, the upper support shoulder 152 may comprise a snap ring disposed in a retaining groove in the lower housing 14.

For reasons that will become clear below, the shear screws 138 that secure the secondary inflation piston 136 to the lower housing 14 are designed to shear at a force corresponding to a pressure less than the predetermined maximum packer setting pressure. For example, in a specific embodiment, the designed shear pressure for the shear screws 138 may be 600 p.s.i. and the predetermined maximum packer setting pressure may be 1,000 p.s.i. It is noted that the designed shear pressure corresponding to the shear screws 132 that secure the primary inflation piston 130 to the lower housing 14 would be 1,000 p.s.i in this specific embodiment.

In operation, after the tool 10 is run into the hole to its setting depth, fluid may be pumped into the tool 10 to set the packer 15. Some of the fluid will pass through the run-in circulation ports 126 in the release piston 18" and either escape around the orifice plugs 128 and through the circulation ports 42, or act on and apply downward pressure to the secondary inflation piston 136. The remainder of the fluid will flow down through the inner bore 20 of the release piston 18" to inflate the packer 15, in the same manner as explained above with regard to the orifice inflation method. When the pressure acting on the packer 15 reaches the designed shear pressure for the shear screws 138, those shear screws 138 will shear and the secondary inflation piston 136 will be forced upwardly by the spring 148 until it comes to rest against the upper support shoulder 152. The pumping operation may be temporarily ceased at this point. When the secondary inflation piston 136 has been moved to this uppermost position, an annular seal 154 on the secondary inflation piston 136 will be positioned above the circulation ports 42 to thereby prevent fluid flow from the run-in circulation ports 128 out of the tool 10 through the circulation ports 42. The one-way ratchet mechanism of the nut 142 prevents the secondary inflation piston 136 from moving back in a downward direction.

Continued pumping of fluid to the packer 15—this time under the bull head inflation method since the circulation ports 42 with the orifice plugs 128 are now blocked, and all of the fluid will be acting on top of the inflation piston 130—will result in the shear screws 132 shearing when the maximum packer setting pressure is reached. This will allow the primary inflation piston 130 to move down to open up a fluid flow path between the run-in circulation ports 126 in the release piston 18" and the secondary circulation ports 134 in the lower housing 14. An upper ball (not shown) may then be dropped into engagement with the upper ball seat 22 to release the release piston 18" and allow the upper housing 12 and the release piston 18" to be retracted to the earth's surface in the same manner as explained above. The CIOT components and the primary inflation piston 130 are left in the well with the lower housing 14 and the packer 15, all of which may be removed to the earth's surface if desired in the same manner explained above for the other embodiments.

From the above description it can be seen that the tool 10 of the present invention in its various embodiments has many advantages and can be used for a variety of different purposes, including allowing circulation while the packer 15 is being run into the well, inflating the packer 15, providing feedback when the packer 15 reaches its maximum inflation pressure, and allowing circulation of a ball to release the tool 10 in order to leave the packer 15 downhole. Further, the tool 10 is not subject to being unintentionally actuated by unforeseen variations in downhole conditions, as is the case with current mechanical release joints.

Whereas the present invention has been described in particular relation to the drawings attached hereto, it should be understood that other and further modifications, apart from those shown or suggested herein, may be made within the scope of the present invention. Accordingly, the invention is therefore to be limited only by the scope of the appended claims.

The invention claimed is:

1. A disconnect tool for use in a subterranean well, comprising:

a first housing releasably connected to a second housing, the second housing having a first fluid circulation port, a second circulation port, and an inner bore therethrough;

a first piston releasably connected to the first housing, and having an inner bore therethrough, an upper ball seat and a lower ball seat, the lower ball seat having a diameter less than a diameter of the upper ball seat, the first piston having a run-in circulation port and an inflation port, the run-in circulation port being in fluid communication with the first circulation port in the second housing before a lower ball is engaged with the lower ball seat, the inflation port directing fluid flow from the inner bore of the first piston to a portion of the inner bore of the second housing below the lower ball seat when the lower ball is engaged with the lower ball seat; and a second piston releasably connected to the second housing, the inflation port being in fluid communication with the second circulation port in the second housing after the second piston is disconnected from the second housing, the first piston being disconnected from the first housing after a second ball is engaged with the upper ball seat to thereby disconnect the first housing from the second housing.

2. The disconnect tool of claim 1, further including an orifice plug engaged with an orifice in the second piston establishing fluid communication between the inflation port and the circulation port in the second housing.

3. The disconnect tool of claim 1, wherein the first housing further includes a lower extension including at least one locking member adapted for releasable engagement with a locking groove in the second housing, and the first piston includes an outer recess disposed to receive the at least one locking member after the first piston has been disconnected from the first housing.

4. The disconnect tool of claim 3, wherein the first piston is disposed to maintain engagement of the at least one locking member with the locking groove before the first piston is disconnected from the first housing.

5. The disconnect tool of claim 1, wherein the second piston is releasably connected to the second housing by at least one shear screw designed to shear at a force corresponding to a maximum setting pressure of a packer to which the tool is connected.

6. The disconnect tool of claim 1, wherein the second housing further includes at least one closure member having an open and a closed position, and adapted to restrict fluid flow through an inner bore of the second housing when in its closed position and permit fluid flow through the inner bore of the second housing when in its open position.

* * * * *